US006026584A

United States Patent [19]

Wegman

[11] Patent Number: 6,026,584

[45] Date of Patent: Feb. 22, 2000

[54] APPARATUS FOR POSITIONING HANGING OBJECTS ON A WALL

[76] Inventor: Myles S. Wegman, 1852 Enterprise Dr., Norcross, Ga. 30093-1107

[21] Appl. No.: 08/960,003

[22] Filed: Oct. 29, 1997

[51] Int. Cl.[7] ..... A47G 1/16

[52] U.S. Cl. ..... 33/613; 33/451; 33/465

[58] Field of Search ..... 33/1 G, 286, 451, 33/452, 465, 469, 482, 485, 613, 644, 645, 809, 456, 460; 248/544

[56] References Cited

U.S. PATENT DOCUMENTS

| | | | |
|---|---|---|---|
| 3,562,919 | 2/1971 | Green | 33/456 |
| 3,808,690 | 5/1974 | Balder | 33/809 |
| 4,220,309 | 9/1980 | Eisen et al. | 33/613 |
| 4,241,510 | 12/1980 | Radecki | 33/451 |
| 4,267,637 | 5/1981 | Paull | 33/1 G |
| 4,443,949 | 4/1984 | Newton | 33/613 |
| 4,455,756 | 6/1984 | Greene | 33/613 |
| 5,103,573 | 4/1992 | Ehling et al. | 33/451 |
| 5,103,574 | 4/1992 | Levy | 33/613 |
| 5,109,611 | 5/1992 | Houck | 33/613 |
| 5,414,938 | 5/1995 | Meek | 33/452 |
| 5,471,760 | 12/1995 | Farris | 33/613 |
| 5,509,213 | 4/1996 | Kelly et al. | 33/451 |
| 5,634,279 | 6/1997 | Ariyo | 33/613 |
| 5,737,990 | 4/1998 | Freeland et al. | 33/465 |
| 5,832,619 | 11/1998 | Scarborough | 33/451 |

*Primary Examiner*—G. Bradley Bennett
*Attorney, Agent, or Firm*—Hinkle & Associates, P.C.

[57] ABSTRACT

An apparatus (10) for positioning hanging objects (2) on a wall has a base member (12), a pair of spaced-apart support arms (18), each having an upper end (20), extending from the base member. At the upper end of each support arm is a line receiver (30) for releasably engaging a line (4) extending from a frame (6) of the object. To enable the individual to place a mark on the wall for the location of a hanger to support the object, the line receiver may have an opening (34) extending therethrough. A telescoping height gauge (36) is mounted to the base member to locate a top edge (8) of the frame with respect to the line suspended front the line receivers. To assist in placing the line receivers in a horizontal relationship on the wall, the apparatus has a level indicator (40). A handle (42) extends from the base member. To add additional strength to the apparatus, a brace (24) can be extended between each support arm and the base member. Also, the support arms can be pivotally mounted to the base member.

17 Claims, 5 Drawing Sheets

20
8
38
32
30
34
36
20
14
26
24
4
32
2
28
30
18
40
24
12
34
26
18
6
42
16

10
38
14
8
30
36
20
30
20
4
28
28
34
34
26
24
24
26
6
18
18
42
22
22
16
10

APPARATUS FOR POSITIONING HANGING OBJECTS ON A WALL

BACKGROUND OF THE INVENTION

I. Field of the Invention

The present invention relates generally to the field of positioning devices. More particularly, the present invention relates to an apparatus to aid in positioning and hanging pictures or similar wall hanging objects.

II. Description of the Related Art

Although a simple task, hanging framed pictures or other similar objects can be tedious and time consuming. One well known approach is to drive a nail or hanger into a wall and suspend the object by the frame from the nail or hanger. Unfortunately, a single suspension point allows the picture to easily shift to a non-level position at the slightest vibration. Such shifting can be reduced by suspending the picture from two or more hangers mounted to the wall. Typically with this approach, a wire is stretched between two mounts, such as screw eyes, which are mounted to either side of the frame, and then placed onto the hangers. However, this approach can involve a number of measurements to determine the appropriate placement of the hangers onto the wall, particularly with respect to the top center of the frame. The problem is exacerbated when there are many pictures being hung, especially when it is desired for the tops of the frames to have the same height from a floor. Of course, the trial and error method can be utilized, but this method can have the drawback of multiple needless holes being placed into the wall which require repair.

U.S. Pat. No. 4,241,510 issued to Radecki describes an aid for hanging pictures having the shape of an inverted tee. This device has a base of oppositely extending, aligned arms and a neck perpendicular to the base. Each arm carries a slide member upon which the wire can be fitted. The slide members, which serve as hanger locators, are moved along the arms to predetermined points so that the hanging wire will not extend above the top of the frame when the picture is hung. The neck of the hanging aid is used to mark the top of the picture. However, the neck is non-telescoping and the user must rely on recording or remembering measurements as indicated by the neck. Further, each slide member is individually adjusted. The hanging aid also has vertical and horizontal leveling devices.

Levy in U.S. Pat. No. 5,103,574 describes a measuring tool for hanging up pictures and the like. The measuring tool has a box-shaped housing that has vertical and horizontal leveling devices. A tape measure is built into the housing and has a L-shaped hook end with an inverted V-notch. An arm is hinge-mounted to the housing. The arm has a second V-notch. Clearly, this device is a measuring device to estimate the location of hangers. It cannot support the weight of the picture and frame and it cannot determine the top center location of the frame.

U.S. Pat. No. 5,103,573 issued to Ehling et al. describes a picture hanging device having an elongated ruler-like body. At the center of the body is a center notch and a horizontal leveling device. A rod extends across the body to frictionally engage conventional picture hooks and predetermined locations. As with Levy, this device cannot support the weight of the picture and frame and it cannot determine the top center location of the frame

SUMMARY OF THE INVENTION

In accordance with the present invention and the contemplated problems which have and continue to exist in this field, one of the objectives of this invention is to provide an apparatus for positioning hanging objects on a wall that enables an individual to quickly and easily eliminiate the unknown of the distance from the top edge of a framed object to the location of horizontally disposed hangers.

It is another object of the present invention to provide an apparatus that has a base member, a pair of support arms extending from the base member, line receivers mounted to the support arms, which define a plane therebetween, and a telescoping height gauge extending from the base member substantially perpendicular to the plane of the line receivers.

It is yet another object of the present invention to provide an apparatus that have pivoting support arms.

It is even another object of the present invention to provide braces extending between the respective support arm and the base member.

Still, it is another object of the present invention to provide a level indicator to place the line receivers in a substantially horizontally position on a wall.

This invention accomplishes the above and other objectives and overcomes the disadvantages of the prior art by providing an apparatus for positioning hanging objects on a wall that is simple in design and construction, inexpensive to fabricate, and easy to use. The apparatus has a base member, a pair of spaced-apart support arms, each having an upper end, extending from the base member. At the upper end of each support arm is a line receiver for releasably engaging a line extending from a frame of the object. To enable the individual to place a mark on the wall for the location of a hanger to support the object, the line receiver may have an opening extending therethrough. A telescoping height gauge is mounted to the base member to locate a top edge of the frame with respect to the line suspended from the line receivers. To assist in placing the line receivers in a horizontal relationship on the wall, the apparatus has a level indicator. A handle extends from the base member. To add additional strength to the apparatus, a brace can be extended between each support arm and the base member. Also, the support arms can be pivotally mounted to the base member and actuated by various means.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent construction insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 1:
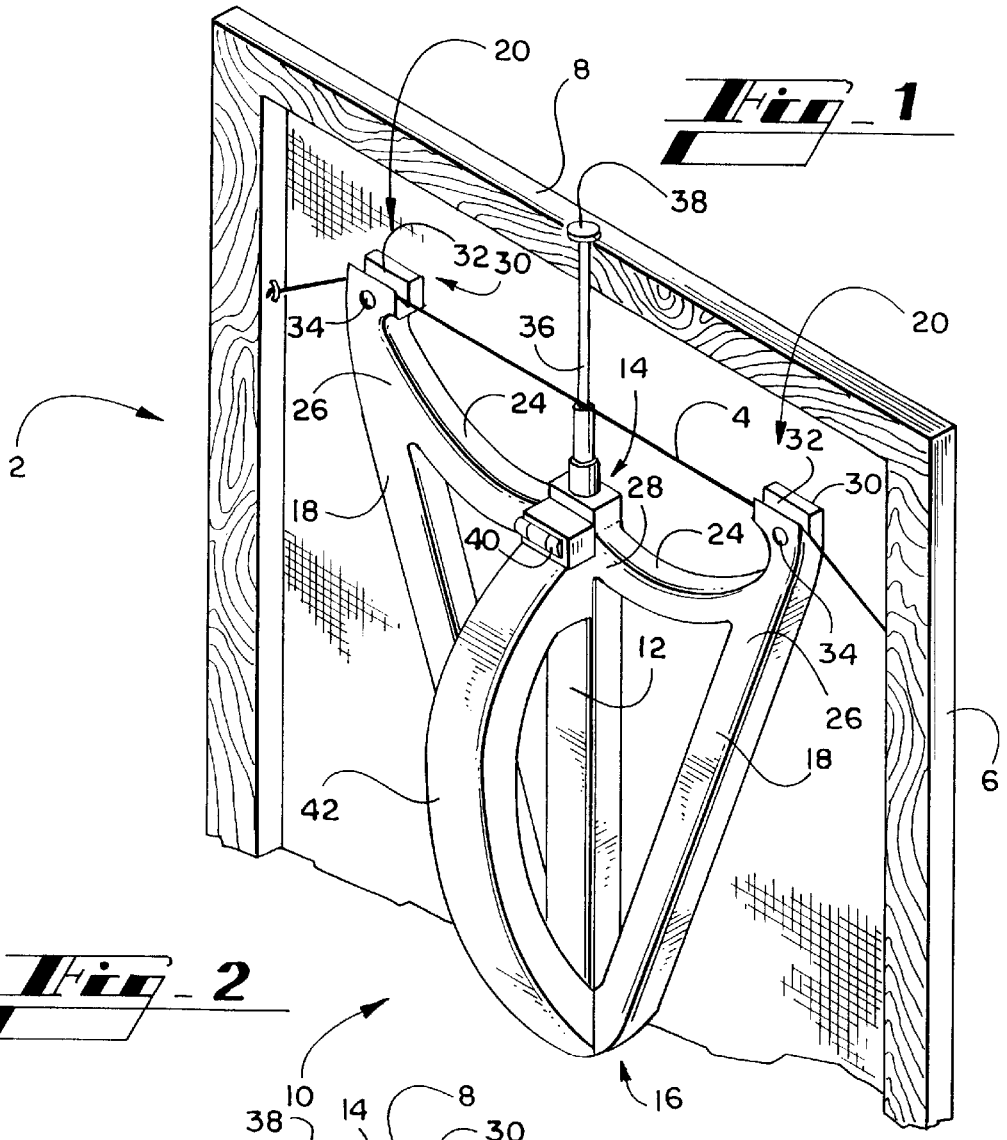
FIG. 1 is a perspective view of an embodiment of an apparatus made in accordance with the present invention in use.

The reference numbers in the drawings relate to the following:

2=object
4=line
6=frame
8=top edge of frame
10=apparatus for positioning hanging objects on a wall
12=base member
14=first end of base member
16=second end of base member
18=support arm
20=upper end of support arm
22=lower end of support arm
24=brace
26=top end of brace
28=bottom end of brace
30=line receiver
32=notch
34=opening
36=height gauge
38=head of height gauge
40=level indicator
42=handle
44=cavity
46 32 shaft and ring assembly
48=shaft
50=ring
52=outer wall of ring
54=brace slot
56=thumb wheel
58=clip
60=gauge slot
62=thumb post
64=plug
66=bore of plug
68=thumb screw
70=screw slot
72=rod
74=port of support arm
76=thumb wheel slot

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates an embodiment of an apparatus 10 made in accordance with the present invention for positioning hanging objects 2 on a wall.

Properly hanging objects, particularly framed pictures, is a geometric mathematical process involving three unknowns. These unknowns are:

1) The location of the top center of the object 2 on the wall,
2) The two set points where the hanging hooks for the object 2 are affixed to the wall, and
3) The distance from the top of the object 2 to a horizontal plane on which the two set points preferably lie level.

The apparatus 10 is readily usable in determining the two set points and the distance from the top of the object 2 to the horizontal plane. The location of the top center of the object 2 is determinable by an individual identifying the desired location.

Figure 2:
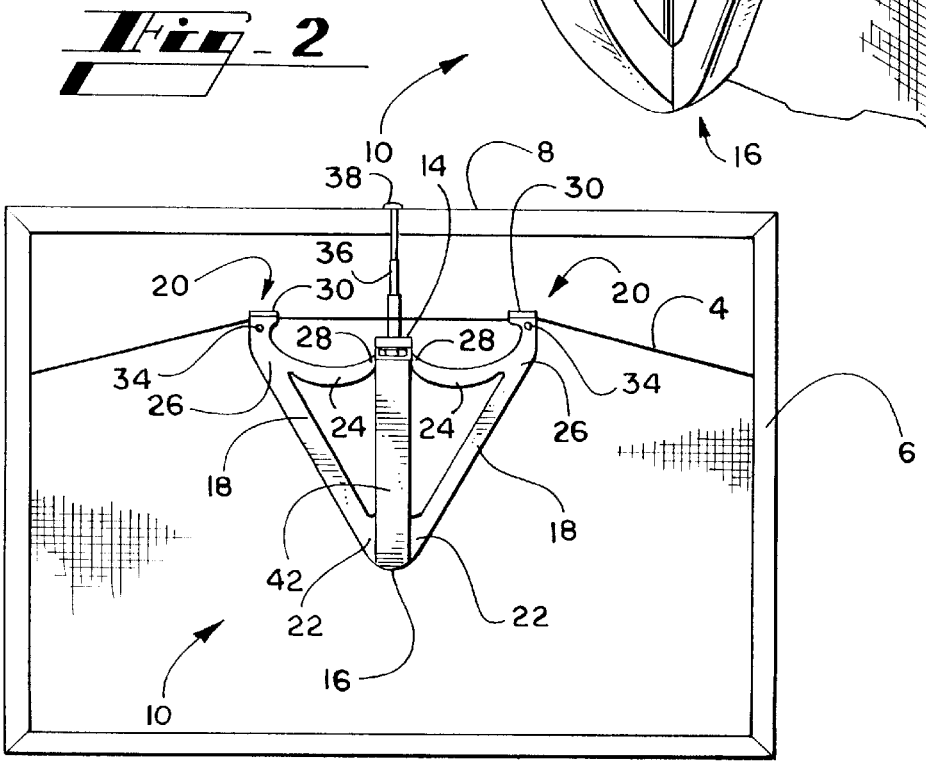
FIG. 2 is a front elevation view of the embodiment of FIG. 1.

Referring to FIGS. 1 and 2, the apparatus 10 has an elongated base member 12 having a first end 14 and a second end 16. Extending outwardly and generally upwardly from the second end 16 of the base member 12 are a pair of spaced-apart elongated support arms 18 having substantially equal length. Each support arm 18 has an upper end 20 and a lower end 22. Preferably, the distance between the upper end 20 of one support arm 18 and the base member 12 is substantially the same as the distance between the upper end 20 of the other support arm 18. Although not shown, the base member 12 and the support arms 18 each have a substantially planar wall contacting surface and the wall contacting surfaces in combination define a substantially planar wall engaging surface (not shown). The wall engaging surface enables the apparatus 10 to flushly contact the wall. Extending between each support arm 18 and the base member 12 is a brace 24 to add additional strength to the apparatus. If the apparatus 10 is manufactured of a material having sufficient sheer stress resistance, the braces 24 are not required. Each brace 21 has a top end 26 and a bottom end 28. In the embodiment of the apparatus 10 shown in FIGS. 1 and 2, each brace 24 extends from the bottom end 28 proximate the first end 14 of the base member 12 to the top end 26 proximate the upper end 20 of the support arm 18. Clearly, the braces 24 can extend from different locations along either the base member 12 or the support arm 18. Preferably, the respective braces 24 are mirror images of one another.

Provided at the upper end 20 of each support arm 18 is a line receiver 30 having a V-shaped notch 32 for releasably engaging a line 4 extending from one portion of a frame 6 to another portion of the frame 6. The line receivers 30 in combination define a horizontal plane extending therebetween. To enable the individual to place a mark on the wall for the location of a hanger to support the object 2, the line receiver 30 has an opening 34 extending therethrough.

Mounted to the first end 14 of the base member 12 is a telescoping height gauge 36 having a head 38. Preferably, the height gauge 36 is disposed substantially perpendicular to the horizontal plane defined by the line receivers 30 and is substantially equal-distant from each line receiver 30. By placing the line 4 into the line receivers 30 so that the apparatus 10 is substantially centered on the line 4, the height gauge 36 can be raised to a position such that the head 38 is at a top edge 8 of the frame 6, thereby indicating to the individual the location of the top edge 8 of the frame 6 with respect to the horizontal plane. Because the line 4 is extended along the horizontal plane, the individual is capable of placing the apparatus 10 in contact with the wall and readily determining the location of the hangers with respect to the desired location of the top edge 8 of the frame 6 of the object 2.

To assist the individual in placing the hangers in a horizontal relationship on the wall, the apparatus 10 has a bubble level type level indicator 40. Although shown being mounted on the base member 12 proximate the first end 14, the level indicator 40 can be disposed at any location on the apparatus 10 as long as the level indicator 40 is both substantially parallel to the wall engaging surface and the plane defined by the line receivers 30.

Figure 6:
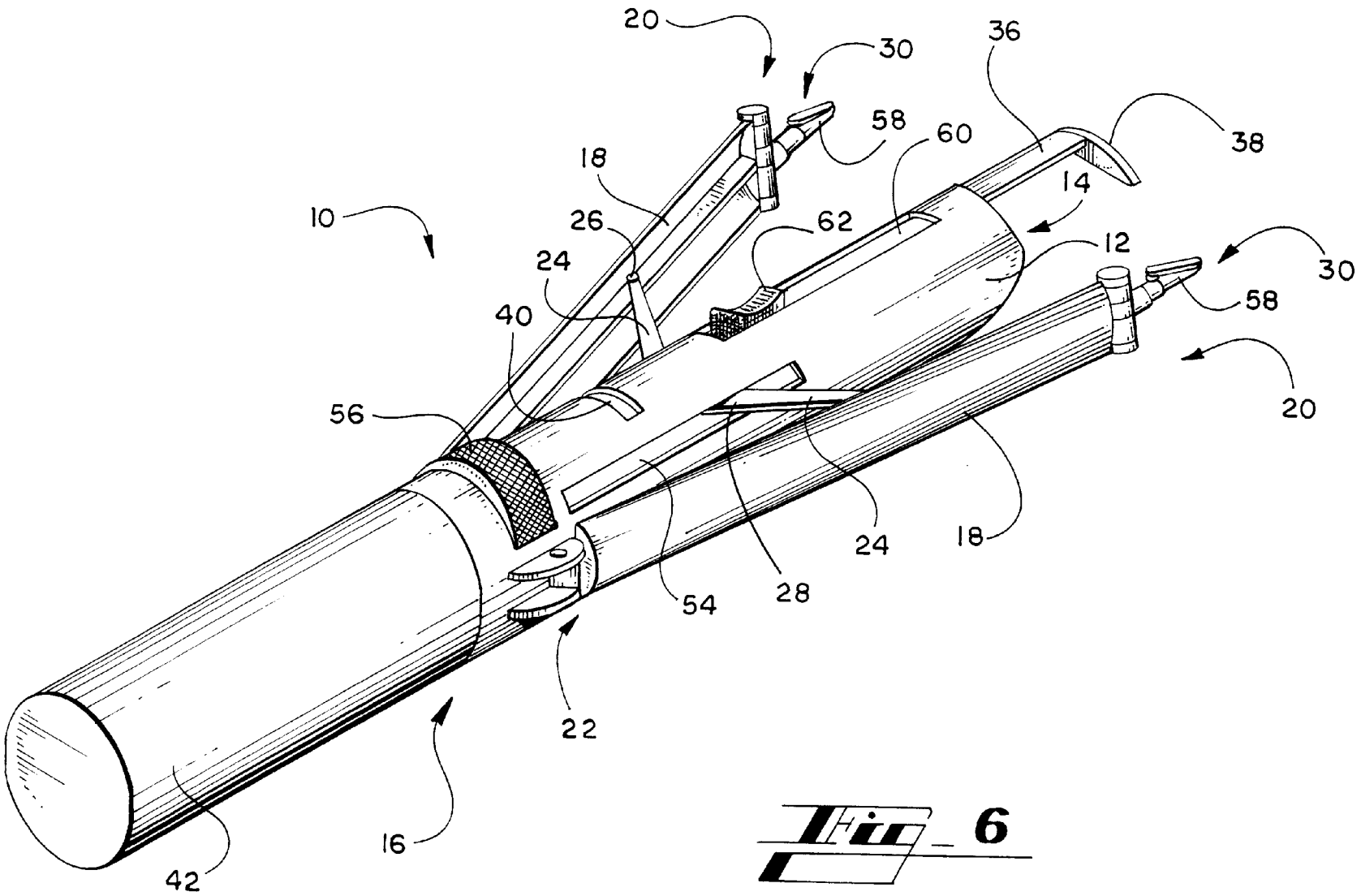
FIG. 6 is a perspective view of another embodiment of the apparatus of FIG. 3.
Figures 7, 8:
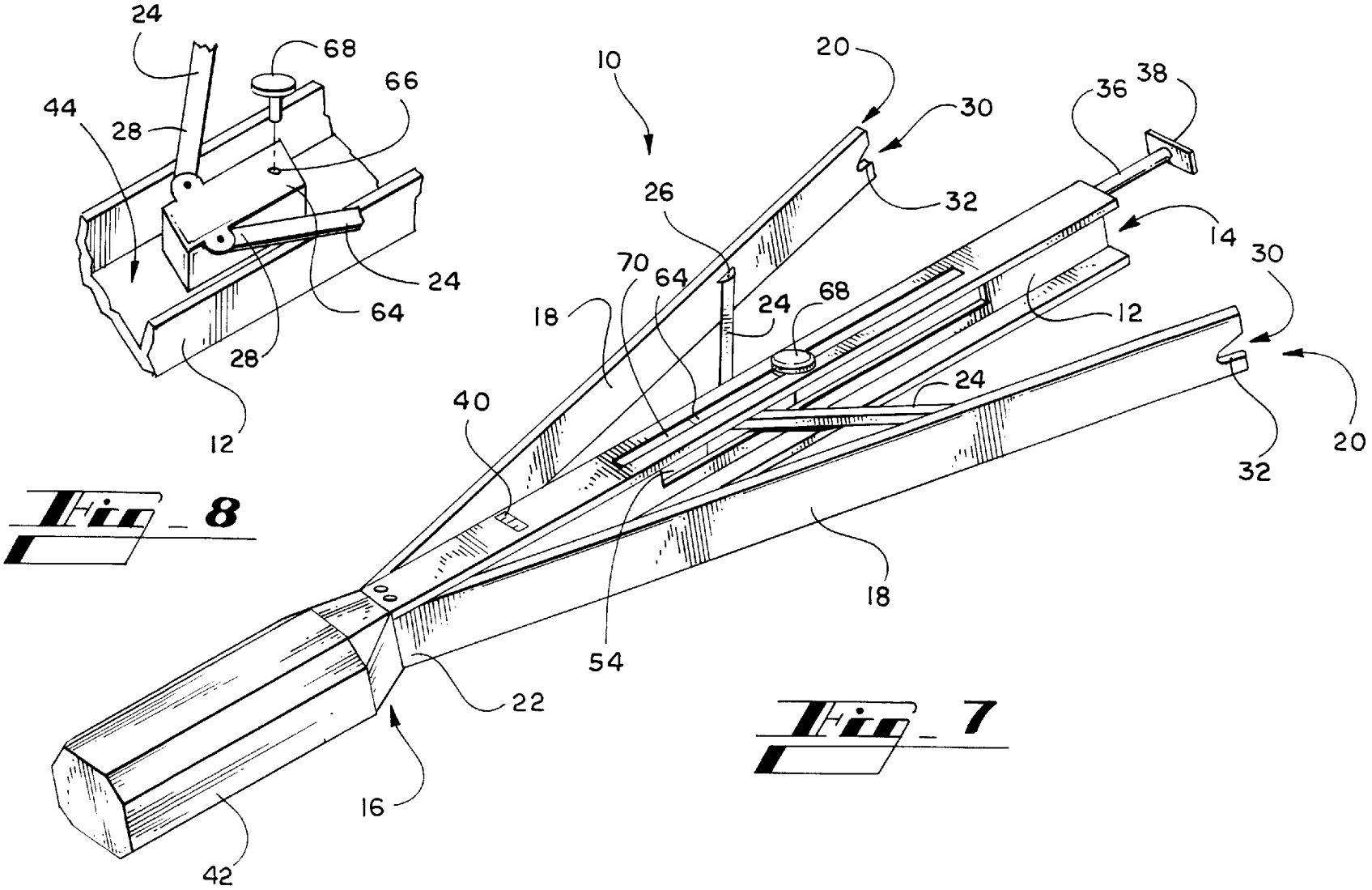
FIG. 7 is a perspective view of yet another embodiment of the apparatus made in accordance with the present invention.
FIG. 8 is a partial, exploded, perspective view of a plug.

An optional handle 42 is mounted to the base member 12. As shown, the handle 42 has a generally semi-circular shape and extends from the base member 12 proximate the first end 14 to the second end 16. Also, the handle 42 can extend from the second end 16 of the base member 12, as shown in FIGS. 3, 6 and 7, and may have any desired shape.

Referring now to FIGS. 3 through 6, another embodiment of the apparatus 10 is shown. In this embodiment, the support arms 18 are pivotally mounted at the lower end 22 to the base member 13 generally proximate the second end 16 so as to accommodate objects 2 of varying size or lines 4 having varying degrees of tension so as to prevent the line 4 from being visible above the top edge 8 of th frame 6. To facilitate movement of the support arms 18, the base member 12 has a cavity 44 containing a shaft and ring assembly 46. The assembly 46 comprises a threaded shaft 48 and a matingly threaded ring 50 disposed upon the shaft 48 with the threads of the shaft 48 and ring 50 in movable engagement. The ring 50 has an outer wall 52 and the braces 24 are pivotally mounted to the outer wall 52 at the bottom end 28. Brace slots 54 are provided on the base member 12 through which the braces 24 can extend. Affixed to the shaft 48 and in rotatable engagement with the base member 12 is a thumb wheel 56. As the thumb wheel 56 is rotated, the shaft 48 likewise rotates, causing the ring 50 to move along a longitudinal axis of the shaft 48 and the support arms 18 to pivot due to the movement of the braces 24 with the ring 50.

Figures 3, 4, 5:
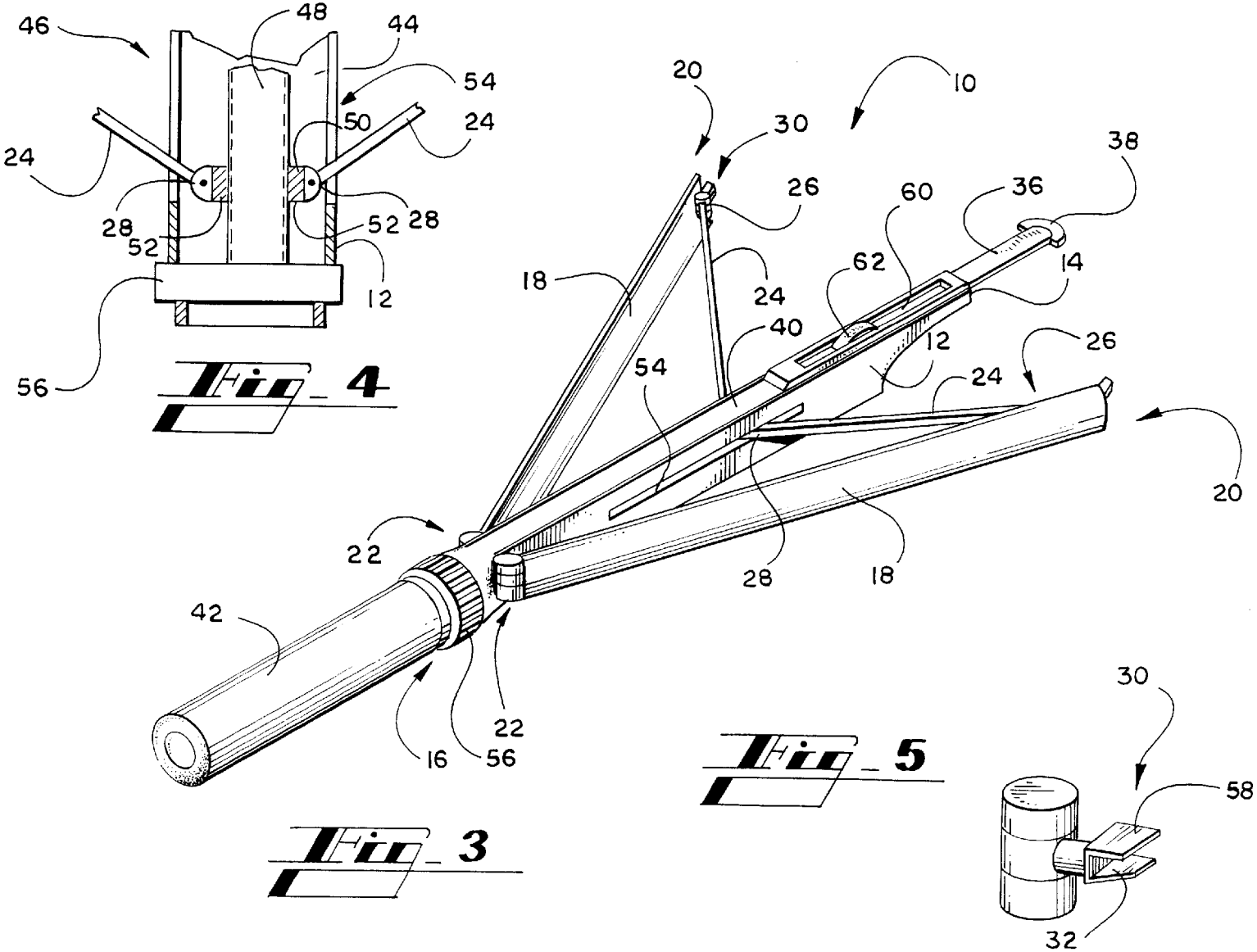
FIG. 3 is a perspective view of another embodiment of the apparatus made in accordance with the present invention.
FIG. 4 is a partial, sectional top view of a shaft and ring assembly.
FIG. 5 is a perspective view of a clip.

In the embodiment shown in FIG. 3, the line receiver 30 is a clip 58 having a reducing notch 32 that is pivotally mounted to the support arm 18 proximate the upper end 20. Once the horizontal plane is determined, individual hangers can be respectively removably placed in the clips 58 and the clips 58 pivoted to assist the individual in installing the hangers on the wall. The embodiment of FIG. 6 utilizes a hinged, pincer-like clip 58.

Again referring to FIGS. 3 and 6, the base member 12 has a gauge slot 60. The height gauge 36 has a thumb post 62 affixed thereto and slidably disposed within the gauge slot 60 to assist the individual in extracting and withdrawing the height gauge 36.

In the embodiment shown in FIGS. 7 and 8, the cavity 44 has plug 64 slidably disposed therein. The ping 64 has a threaded bore 66 to removably receive a matingly threaded thumb screw 68 that is inserted through a screw slot 70 of the base member 12. By tightening the thumb screw 68 into secure engagement with the base member 12, the support arms 18 can be locked into place. The braces 24 are pivotally mounted to the plug 64 so that as the plug 64 moves within the cavity 44, the support arms 18 pivot.

Figure 9:
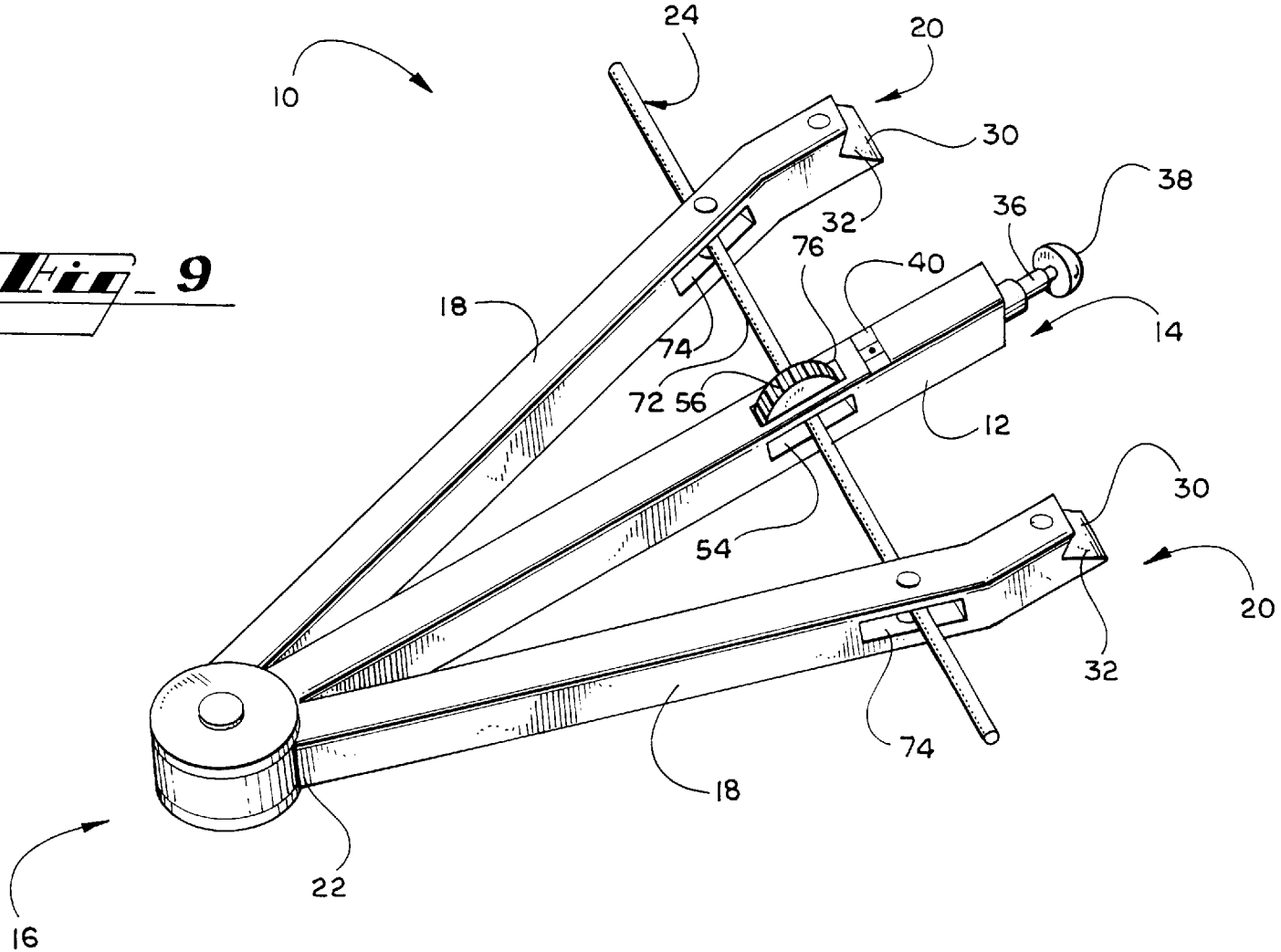
FIG. 9 is a perspective view of still another embodiment of the apparatus made in accordance with the present invention.

Now referring to FIG. 9, yet another embodiment of the present invention is shown. In this embodiment, the braces 24 comprise an elongated threaded rod 72 of unitary construction. The support arms 18 have matingly threaded ports 74 and the rod 72 is rotatably disposed through the ports 74 and the brace slot 54. A thumb wheel 56 is affixed to the rod 72 and extends through a thumb wheel slot 76 of the base member 12. As the thumb wheel 56 is rotated, the rod 72 rotates in threaded engagement with the ports 74 of the support arms 18, causing the support arms 18 to pivot at their pivotal mount with the base member 12 at the respective lower ends 22.

In use, the individual places the line 4 of the object 2 onto the line receiver 30 so that the base member 12 is generally at the center of the line 4 and suspends the object therefrom. Next, the height gauge 36 is raised until the head 38 is level with the top edge 8 of the frame 6. The individual removes the apparatus 10 from the object 2 and places wall engaging surface of the apparatus 10 in contact with the wall such that the head 38 of the height gauge 36 is at the desired location for the centered top edge 8 of the object 2. By using the level indicator 40, the individual can adjust the plane of the line receivers 30 to be in a horizontal position on the wall. The horizonal position of the line receivers 30 is marked on the wall, and individual hangers mounted to the wall at the respective marks. Finally, the object 2 is be suspended on the wall by placing the line 4 onto the hangers.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An apparatus for positioning hanging objects on a wall, the object having an object top and an object line anchored to the object, the apparatus comprising:

a base member having a first end and a second end;

a pair of spaced apart support arms extending outwardly from the base member proximate the second end, each support arm having an upper end, the support arms being substantially equidistant from the base member;

a pair of spaced apart braces extending respectively between the base member and each support arm;

a line receiver at the upper end of each support arm to releasably engage the object line, the line receivers in combination with each other defining an horizontal plane extending therebetween;

a telescoping height gauge movably extending from the base member for indicating the location of the object top relative to the horizontal plane, the height gauge extending substantially perpendicular to the horizontal plane;

a bubble level indicator mounted to the base member; and a handle extending from the base member and cooperatively engaging the support arms.

2. An apparatus as claimed in claim 1, wherein each support arm has a lower end and is pivotally mounted to the base member at the lower end, and further comprising means for pivoting the support arms.

3. An apparatus as claimed in claim 2, further comprising a level indicator mounted to the base member.

4. An apparatus as claimed in claim 2, further comprising a handle extending from the base member.

5. Am apparatus as claimed in claim 1, wherein the base member has a cavity, each support arm has a lower end and is pivotally mounted to the base member at the lower end, each brace has a top end and a bottom end and is pivotally mounted to the respective support arm at the top end, and further comprises:

a rotatable threaded shaft disposed within the cavity;

a matingly threaded ring placed around the shaft, the threads of the ring rotatable engaging the threads of the shaft, the ring having an outer wall and being pivotally mounted to each brace at the bottom end; and a thumb wheel rotatably engaging the base member and being mounted to the shaft for rotating the shaft, whereby as the thumb wheel rotates, the support arms pivot at the respective lower ends.

6. A apparatus as claimed in claim 5, further comprising a level indicator mounted to the base member.

7. An apparatus as claimed in claim 6, wherein the level indicator is a bubble level.

8. An apparatus as claimed in claim 5, further comprising a handle extending from the base member.

9. An apparatus as claimed in claim 1, wherein the base member has a cavity, each support arm has a lower end and is pivotally mounted to the base member at the lower end, each brace has a top end and a bottom end and is pivotally mounted to the respective support arm at the top end, and further comprises:

a plug disposed within the cavity and slidingly engaging the base member, the plug having a threaded bore and being pivotally mounted to the lower end of each support arm;

a threaded locking screw extending into the cavity, matingly engaging the threaded bore of the plug and releasably engaging the base member; and whereby as the plug slides within the cavity, the support arms pivot at the respective lower ends.

10. An apparatus as claimed in claim 9, further comprising a level indicator mounted to the base member.

11. An apparatus as claimed in claim 10, wherein the level indicator is a bubble level.

12. An apparatus as claimed in claim 9, further comprising a handle extending from the base member.

13. An apparatus as claimed in claim 1, wherein the line receivers have an opening therethrough for an operator to insert a marking instrument and indicate on the wall the location of a hanger.

14. An apparatus for positioning hanging objects on a wall, the object having all object top and an object line anchored to the object, the apparatus comprising:

a base member having a first end and a second end;

a pair of spaced apart support arms extending outwardly from base member proximate the second end, each support arm having an upper end;

a line receiver at the upper end of each support arm to releasably engage the object line, the line receivers in combination with each other defining a horizontal plane extending therebetween; and telescoping height gauge movably extending from the base member for indicating the location of the object top relative to the horizontal plane.

15. An apparatus as claimed in claim 14, wherein each support arm has a lower end and is pivotally mounted to the base member at the lower end, and further comprising means for pivoting the support arms.

16. An apparatus as claimed in claim 14, further comprising a level indicator mounted to the base member.

17. An apparatus as claimed in claim 14, further comprising a handle extending from the base member.

* * * * *